US006901784B1

(12) United States Patent
Justice

(10) Patent No.: US 6,901,784 B1
(45) Date of Patent: Jun. 7, 2005

(54) COUNTERSINKING TOOL

(76) Inventor: Mark Justice, 885-68th St., Amery, WI (US) 54001

( * ) Notice: Subject to any disclaimer, the term of this patent is extended or adjusted under 35 U.S.C. 154(b) by 0 days.

(21) Appl. No.: 10/769,655

(22) Filed: Feb. 2, 2004

(51) Int. Cl.[7] ..... B21D 1/12; B21D 9/05; B23P 19/00

(52) U.S. Cl. ..... 72/414; 72/412; 72/454

(58) Field of Search ..... 72/454, 453.17, 72/412, 414, 115

(56) References Cited

U.S. PATENT DOCUMENTS 2,226,852 A * 12/1940 Dobrick ..... 72/317
2,292,446 A * 8/1942 Huck ..... 72/412
2,423,957 A * 7/1947 Amtsberg ..... 72/453.17
4,445,264 A * 5/1984 Banerian ..... 72/454
4,495,687 A * 1/1985 Sieveking ..... 72/454
4,761,987 A * 8/1988 Gamauf ..... 72/414
5,230,237 A * 7/1993 Johansson ..... 72/454

* cited by examiner

*Primary Examiner*—David Jones

(57) ABSTRACT

A countersinking tool for countersinking openings into a hollow metal door frame in order to insert wall anchors through the openings to lie flush with the door frame. The countersinking tool has two parts. The nut is a base with a threaded opening extending lengthwise through its center. The bolt has a hexagonal-sided top that tapers to a threaded screw insertable into the threaded opening of the nut.

1 Claim, 4 Drawing Sheets

COUNTERSINKING TOOL

BACKGROUND OF THE INVENTION

The field of the invention is countersinking tools, specifically, tools for making countersunk openings in hollow metal door frames.

Hollow steel door frames are attached to the walls adjacent the doorway by means of wall anchors. In order for the wall anchors to hold the door frame securely in position and to provide a professional appearance, the wall anchors should be inserted through openings drilled into the door frame to a sufficient depth that the wall anchors are flush with the door frame. To do this, the drilled opening should be countersunk in the direction and to the depth the wall anchor is to be inserted.

Sometimes the door frame comes from the factory with the countersunk holes already drilled, but usually not. If there are no factory-drilled countersunk openings, workmen have to drill and countersink the openings at the worksite. At present there is no tool available for doing this. Workmen usually use either a steel rod or a balpeen hammer to drive the wall anchor into the door frame. This is a difficult process that does not yield uniformly satisfactory results.

SUMMARY OF THE INVENTION

The object of the invention is to provide a tool for easily countersinking drilled holes into hollow metal door frames.

The tool has two parts (a bolt and a nut). The bolt has a threaded screw that fits into a threaded opening in the nut that extends the length of the nut. To use the tool, the nut is placed under a hole that has been drilled into the door frame, and the bolt is placed against the drilled hole in the door frame in the direction the worker wants to countersink the opening. The worker then cranks the screw of the bolt into the metal surrounding the opening until the opening has been countersunk to the desired depth.

DETAILED DESCRIPTION OF THE INVENTION

Figure 1:
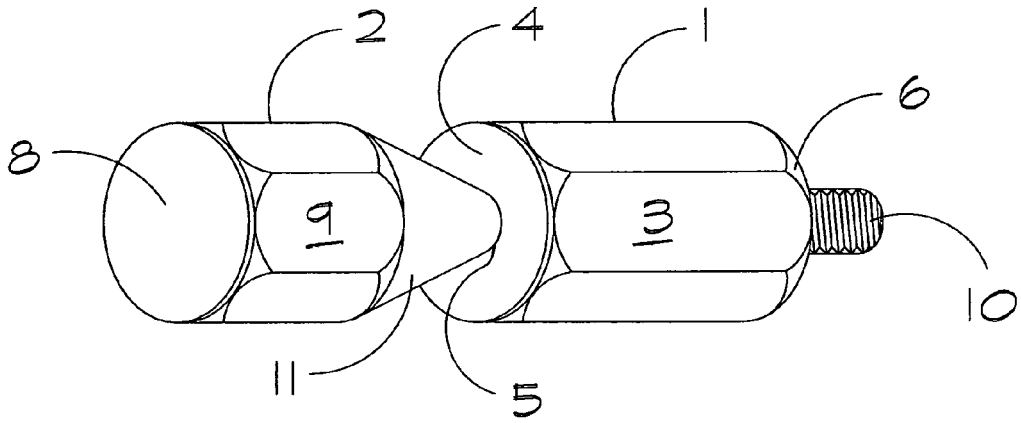
FIG. 1 is a side perspective view of the invention.
Figure 2:
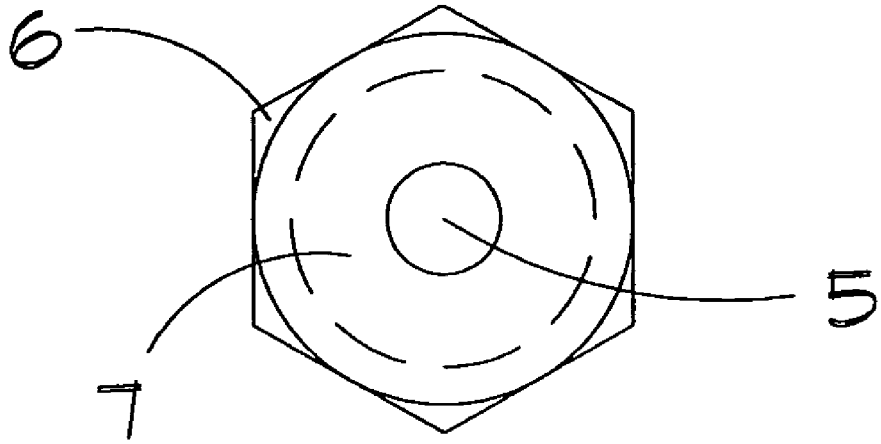
FIG. 2 is a bottom view of the nut.
Figure 3:
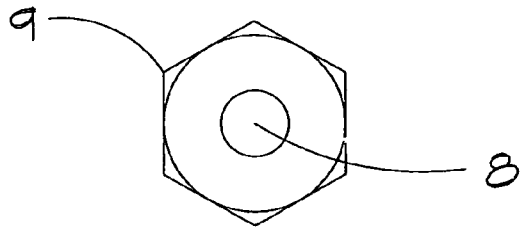
FIG. 3 is a top view of the bolt.
Figure 4:
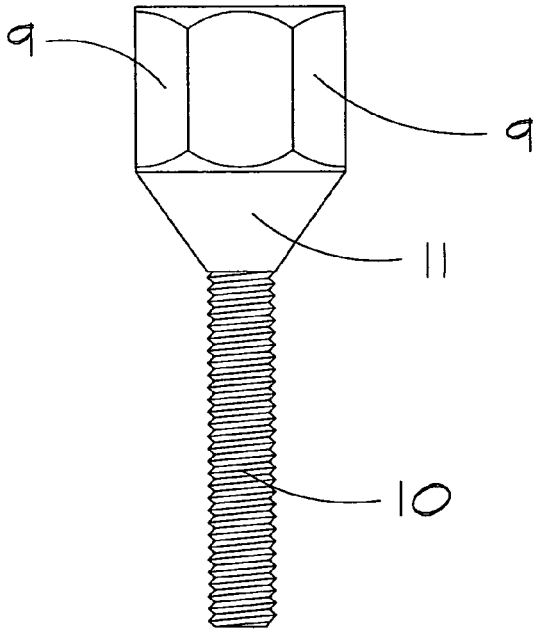
FIG. 4 is a front view of the bolt.
Figure 5:
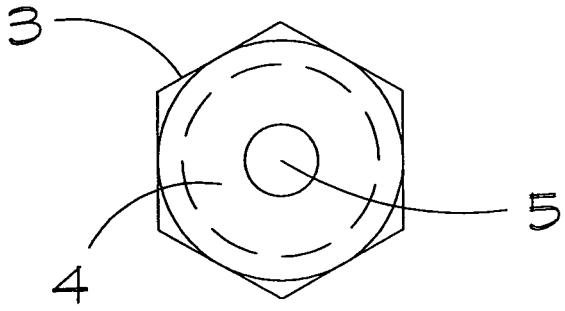
FIG. 5 is a top view of the nut.
Figure 6:
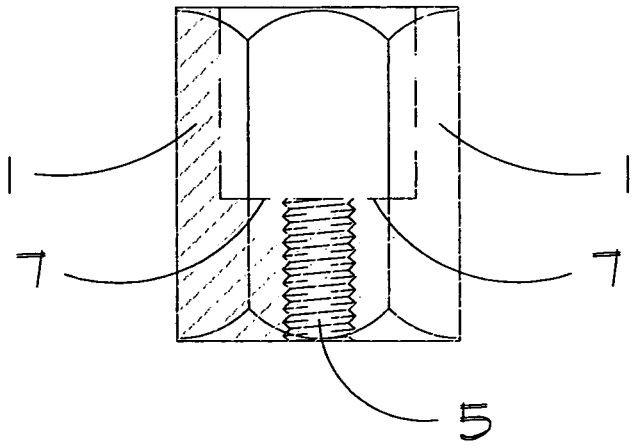
FIG. 6 is a longitudinal section view of the nut.

The invention is a countersinking tool designed to countersink openings into a hollow metal door frame in order to allow a wall anchor to be inserted into each of said openings to a depth that will allow the wall anchors to lie flush with the door frame. The countersinking tool has two parts, namely, a nut 1 and a bolt 2. The door frame fits between the nut 1 and the bolt 2 while the countersink is being drilled.

The nut 1 is a base that has hexagonal sides 3 (exteriorly) and a flat circular top 4 that has a threaded opening 5. The bottom 6 of the nut 1 is indented, that is, the exterior surface is a flat circular rim surrounding a large center opening, and recessed about halfway along the length of the nut 1 is a flange 7 that has a smaller threaded opening which is the other end of the threaded opening 5 that begins at the flat circular top 4. The threaded opening 5 thus extends longitudinally through the center of the nut 1 to form a cylindrical channel.

The bolt 2 has a top portion that has a flat circular top 8 and hexagonal sides 9 that taper to a threaded screw 10. The tapered portion 11 of the sides 9 may be smooth and conically rounded as shown, or it may be six-sided all the way to the screw 10 if the top portion of the bolt 2 is made from a single piece of hex steel. The threaded screw 10 is longer than the nut 1 so that the screw 10 will project beyond the bottom edge 6 of the nut 1 when completely inserted into the threaded opening 5. At the point of maximum insertion, the bottom of the tapered portion 11 of the bolt 2 will be in contact with the part of the flat circular top 4 of the nut 1 that surrounds the threaded opening 5.

To use the countersinking tool, the worker first drills a hole into the hollow metal door frame. The nut 1 is placed against the door frame underneath the drilled hole. The bolt 2 is placed against the hole on the opposite side of the door frame (the side to be countersunk). Holding the bolt 2 along some of the hexagonal sides 9, the worker cranks the bolt 2 into the metal surrounding the drilled hole, inserting the threaded screw 10 into the threaded opening 5 of the nut 1 until a countersink of the desired depth has been formed. The countersinking tool is then unscrewed and withdrawn, and the wall anchor is inserted into the countersunk opening.

I claim:

1. A countersinking tool adapted to countersink openings into a hollow metal door frame in order to allow wall anchors to be inserted into said openings so that said wall anchors lie flush with said door frame, said countersinking tool comprising:

a nut which is a base having hexagonal sides and a flat circular top, said nut having formed therein a threaded opening extending longitudinally through the center of said nut;

and a bolt having a top portion with hexagonal sides which taper to a threaded screw, said threaded screw being longer than said nut and being insertable into said threaded opening formed into said nut.

* * * * *